United States Patent [19]

Barten

[11] 4,045,754

[45] Aug. 30, 1977

[54] ECCENTRICALLY MOUNTED SIX-POLE RINGS FOR A STATIC CONVERGENCE UNIT

[75] Inventor: Piet Gerard Joseph Barten, Eindhoven, Netherlands

[73] Assignee: U.S. Philips Corporation, New York, N.Y.

[21] Appl. No.: 646,046

[22] Filed: Jan. 2, 1976

[30] Foreign Application Priority Data

Mar. 13, 1977 Netherlands ..... 7502970

[51] Int. Cl.[2] ..... H01F 1/00

[52] U.S. Cl. ..... 335/212; 335/210

[58] Field of Search ..... 335/210, 212, 213

[56] References Cited

U.S. PATENT DOCUMENTS 3,290,534 12/1966 Kratz ..... 335/212 X

Re. 27,698 7/1973 Werst ..... 335/212

*Primary Examiner*—George Harris

*Attorney, Agent, or Firm*—Frank R. Trifari

[57] ABSTRACT

Two six-pole annular magnetic structures are arranged about the neck of a three-in-line color display tube so as to be eccentric with respect to each other and with respect to the center of the neck. The center of one six-pole is situated halfway between the central electron beam and one outer electron beam. The two beams on both sides of the center of the six-pole, consequently, are subjected to equal forces of the same direction. The third beam is subjected to a force in the same direction, but this force is nine times larger due to the three times as large distance from the center of the six-pole and due to the square-law field variation thereof. Because of their identical direction and value, the forces acting on the former beams will not disturb the convergence therebetween.

6 Claims, 8 Drawing Figures

ECCENTRICALLY MOUNTED SIX-POLE RINGS FOR A STATIC CONVERGENCE UNIT

The invention relates to a device for the static convergence of electron beams which are situated in one plane in the neck of a colour television display tube, the said device being arranged about the neck of the display tube and comprising at least two annular magnetic structures which are eccentrically arranged with respect to each other and to the longitudinal axis of the colour display tube.

A device of this kind is known from U.S. Pat. No. 3,701,065 which describes how, using two pairs of permanent magnet ferrite rings, the static convergence of the outer electron beams with the central electron beam of three-in line a colour display tube is realized. The permanent magnetic rings are arranged outside the neck of the colour display tube and are mirrored with respect to the centre of the neck, the strength and the orientation of the magnetic field generated by the rings being adjustable.

One pair of permanent magnet rings serve to converge the nearest electron beam with the central electron beam. However, the relevant pair of rings has a non-ignorable effect on the other two electron beams, so that the control of the convergence for an outer electron beam with the other electron beams cannot be effected without the convergence for the other beams being disturbed.

The invention has for its object to make the adjustment of an outer electron beam more independent from other electron beams, thus resulting in a simpler adjusting procedure.

To this end, the invention is characterized in that the annular magnetic structures enclose the neck of the colour display tube, each structure generating a six-pole magnetic field.

The axis of rotation of a first magnetic structure is preferably situated halfway between one outer electron beam and the central electron beam, the axis of rotation of a second magnetic structure being preferably situated half way between the central electron beam and the other electron beam. If the axis of rotation is situated halfway between the beams A and B, the magnetic structure exerts a force of the valve F in the same direction on the beams A and B. On the beam C, being situated three times as far from the axis of rotation of the magnetic structure, a force amounting to $9 \times F$ is exerted due to the square-law variation of the field within the annular structure. Due to the large difference in forces exerted on beam C and beams A and B, beam C can be converged with beam A and B, the convergence of the beams A and B which respect to each other not being disturbed by the forces in the same direction which act on the beams A and B and which are equally large.

In order to enable the generated forces to act in any desired direction, a preferred embodiment of the device according to the invention is characterized in that a magnetic structure is rotatable about an axis of rotation at least through an angle of 120°.

The adjustment of the convergence can be further simplified by separating the horizontal and the vertical corrections. A device offering this advantage is characterized in that the device comprises four magnetic structures, each of which consists of a six-pole magnetic which is exclusively adjustable as regards magnetic strength. The first and the third magnetic structure having axes of rotation which coincide, as do the axes of rotation of the second and the fourth magnetic structure magnetic poles of the first and second structure are situated halfway between the magnetic poles of the third and the fourth structures, respectively.

Using such a device, the horizontal and the vertical correction for the one outer beam as well as for the other beam is substantially independently adjustable. The necessary adjusting procedure is thus reduced to a short series of simple manipulations.

The invention will be described in detail hereinafter with reference to a drawing.

FIG. 1 is a diagrammatic side elevation of a colour display tube having convergence units secured thereon.

FIG. 2*a* shows a part of the device according to the invention and the operation thereof.

FIG. 2*b* is a diagrammatic representation of a device according to the invention and the operation thereof, FIG. 3 is a front view of an embodiment of a device according to the invention, FIG. 4 is a sectional view of the device taken along the line IV—IV in FIG. 3, FIG. 5 is a diagrammatic front view of an electromagnetic convergence unit according to the invention.

Figure 1:
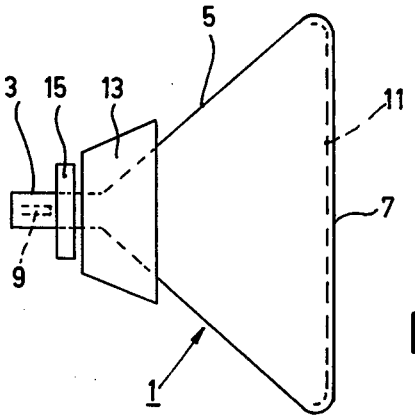
Figure 2A:
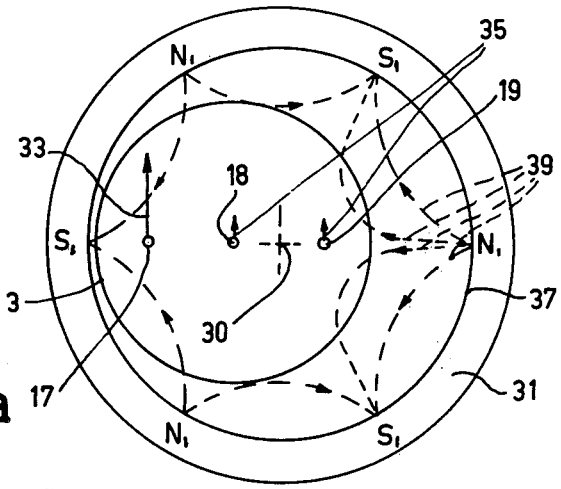

The colour display tube 1 shown in FIG. 1 comprises a cylindrical neck 3, which changes over into a flared portion 5 which adjoins a display screen 7. Using three adjacently arranged electron guns 9 (only one of which is shown) in the neck 3, three electron beams extending in one plane can be generated. The entire display screen 7 can be scanned by the electron beams by means of a deflection system 13. In order to enable correction of the direction of the non-deflected electron beam, so that they coincide on a target on the screen 7, a device 15 for adjusting the static convergence of the electron beam is provided about the neck 3. FIG. 2*a* shows a portion 31 of the device 15 which is used for achieving static convergence of electron beam 17 with beam 18. So as to decouple the adjustment of the beams 17 and 19 from each other as much as possible, the six-pole permanent magnet structure 31 is eccentrically arranged about the neck 3, such that the centre 30 of the structure 31 is situated halfway between the beam 18 and 19. Due to the square-law variation of the magnetic field 39 from the centre 30 towards the edge 37, a force 33 will act on the beam 17 which is nine times larger than the force acting on the beam 19, because the distance between the centre 30 and the beam 17 is three times larger than the distance between the centre 30 and the beam 19. It will be obvious that a force 35 acts on the beam 18 which is equal to the force acting on the beam 19. Consequently, the convergence of the beam 17 with the beam 18 will not influence the position of the beam 18, and that of beam 19 with respect to each other, and will little influence on the two beams together. By rotating the structure 31 about its axis 30, the direction of the forces 33 and 35 can be adjusted. If the structure 31 is composed of two six-pole permanent magnet rings in known manner (not shown), the value of the forces 33 and 35 can also be adjusted by rotating the rings with respect to each other. The ratio of the forces 33 and 35 is not influenced thereby.

Figure 2B:
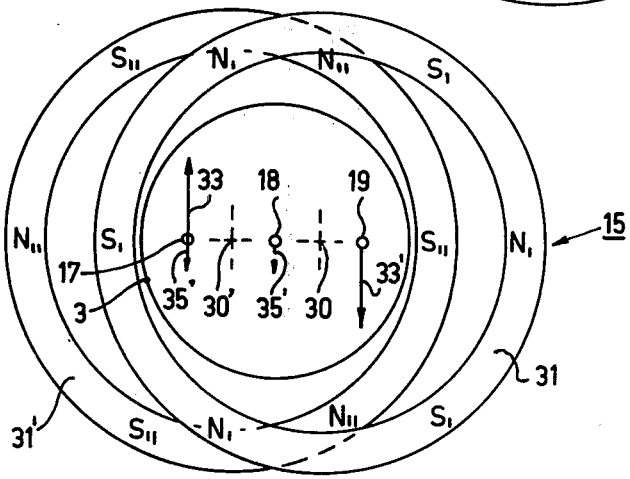

FIG. 2*b* shows that the beans 17 and 19 can be converged with the beam 18 by means of two six-pole permanent magnet structures 31' and 31 which are eccentrically arranged about the neck 3. The structure 31 exerts the force 33 on the beam 17 (the forces 35 of the beams 18 and 19 are not shown). Independent thereof, the structure 31' exerts comparatively small forces 35' on the beams 17 and 18 and a large force 33' on the beam 19. Consequently, the outer beams 17 and 19 are independently subject to the forces 33 and 33', the other forces 35' and 35 developed (the latter not shown in FIG. 2*b*) being substantially neglectable. The electron beams 17 and 19 can thus be converged with the central beam 18 independent of each other.

By rotation of the structures 31 or 31' about their axes of rotation 30 and 30', the direction of the forces 33 and 33' can be adjusted.

The corrections to be performed on the beams are preferably separated into corrections in the horizontal direction and in the vertical direction, which can be performed independent of each other. This is achieved by means of two additional six-pole permanent magnet structures which are also eccentrically arranged about the neck of the picture tube. The added structures are rotated with respect to the already present structures 31 and 31' such, that the forces exerted by the added structures are perpendicular to the forces 33 and 33' generated by the structures 31 and 31'. For this purpose, the centre of the added structure should coincide with the centre 30 of the structure 31, and the centre of the other structure should coincide with the centre 30' of the structure 31'. The magnetic fields of the added structures should be perpendicular to the magnetic fields of the structures 31 or 31'. This requirement is satisfied if the poles of the added structures are situated halfway between the poles of the structures 30 and 31'. Using this construction, a device is obtained in which the landing points of the outer electron beams 17 and 19 on the display screen 7 can be independently moved in the horizontal and the vertical direction, independent of each other.

Figure 3:
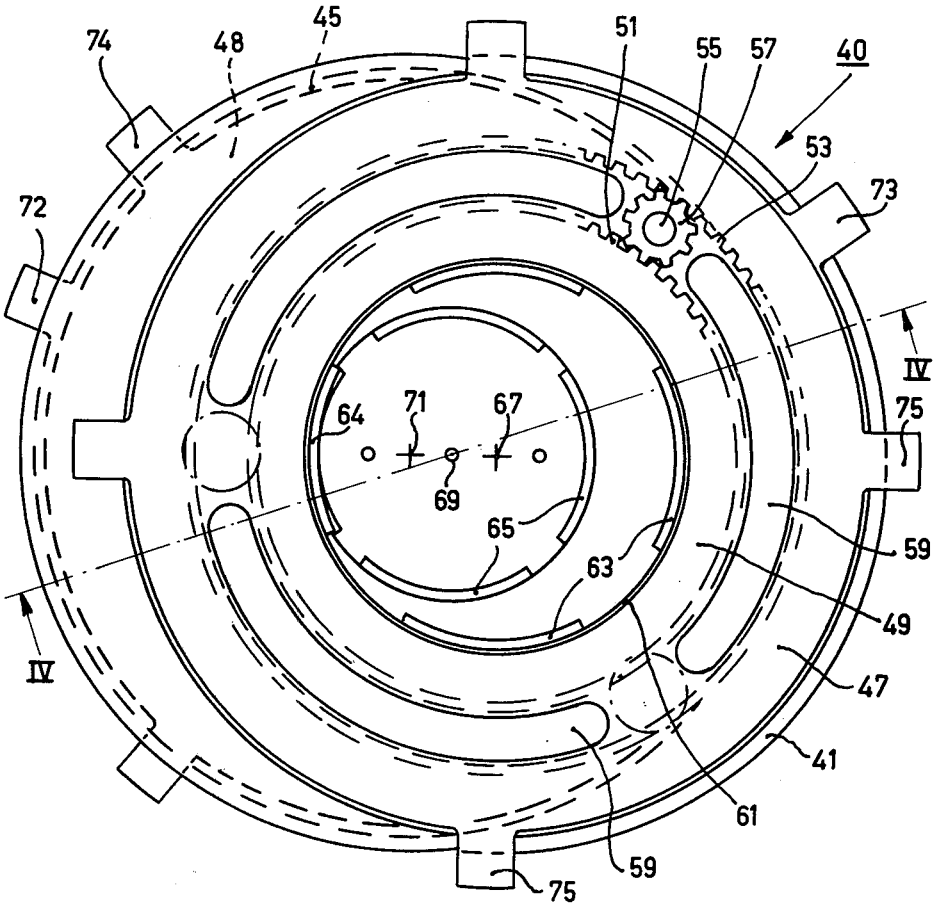
Figure 4:
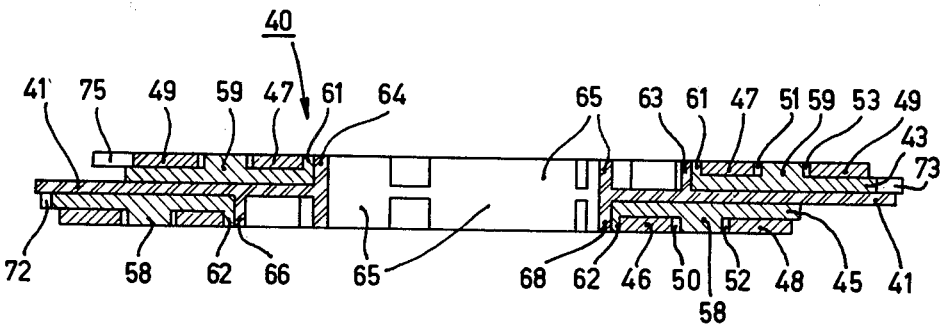

FIGS. 3 and 4 are a front view and a sectional view, respectively, taken along the line IV—IV in FIG. 3, of an embodiment of a device 40 according to the invention.

The device 40 comprises two permanent magnet structures which are both composed of identical components on a carrier 41. Holders 43 and 45 are arranged on both sides on the carrier 41. On the holders 43 and 45 permanent magnet rings are arranged, as can be seen an inner ring 47 and an outer ring 49 are arranged on the holder 43, and an inner ring 46 and an outer ring 48 are arranged on the holder 45. The inner rings 46, 47 are toothed on the outer edge. The inner edge of the outer rings 48, 49 is provided with teeth 52, 53. On the holder 43 a shaft 55 is formed on which a pinion 57 is journalled. The pinion 57 co-operates with the teeth 51 and 53 of the rings 47 and 49. When the outer ring 49 is rotated clockwise, the inner ring 47 will be rotated anti-clockwise due to the action of the pinion 57. The holder 45 has an identical construction (not shown in FIG. 3), whereby the rings 46 and 48 can be simultaneously rotated in opposite directions. On the holders 43, 45 there are provided guides 59, 58 for centring the inner rings 47, 46 and the outer rings 49, 48 and for guiding the rings during rotation. It follows that a desired functioning of the device 40 can be achieved already by way of one pinion on each side.

The assembly 43, 47, 49, 57 is mounted to be rotatable on the carrier 41. The edge 61 of the holder 43 and the raised collars 63 and 64 of the carrier 41 constitute a sliding bearing for the holder 43. The edge 61 is of circular shape and eccentric with respect to the mounting collars 65 of the carrier 41, the centre 67 of the circular edge 61 being situated to the right of the centre 69 of the carrier 41. Similarly, the holder 45 has an edge 62 about collars 66 and 68 which is of circular shape and eccentric with respect to the mounting collars 65. The centre 71, however, is situated to the left of the centre 69.

On the holders 43, 45 lugs 73, 72 are formed whereby each of the holders can be individually rotated with respect to the carrier 41. Lugs 75, 74 are also present on the outer rings 49, 48, whereby the rings 47 and 49, 46 and 48, respectively can be rotated in opposite directions.

Figure 5:
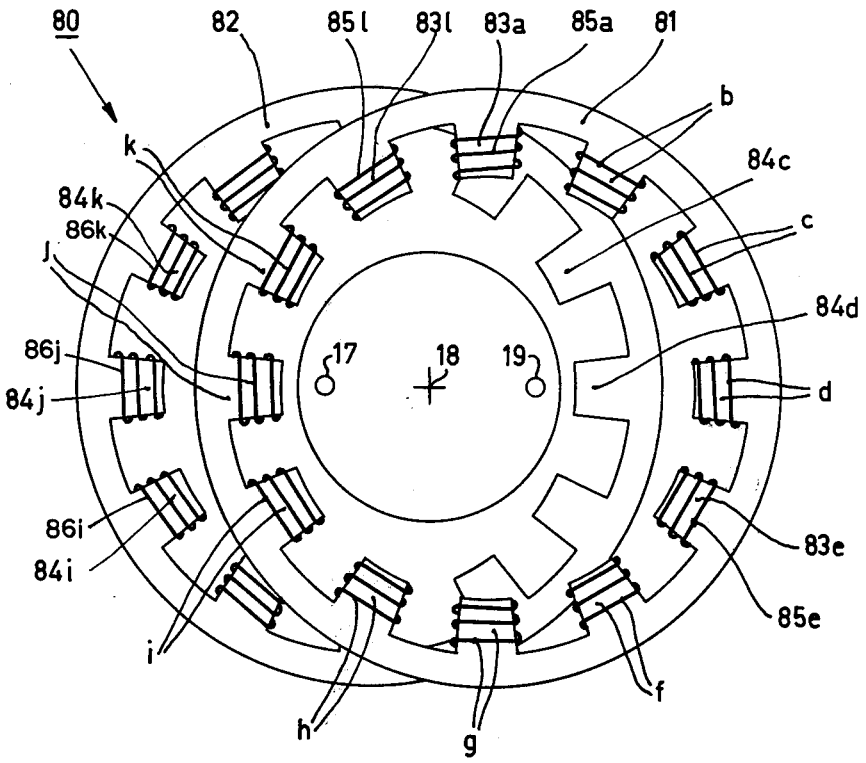

FIG. 5 diagrammatically shows an embodiment 80 of an electromagnetic static convergence unit according to the invention, whereby the corrections to be performed on the electron beam 17 as well as the electron beam 19 can be effected in two perpendicular directions. The convergence unit 80 consists of two rings 81 and 82 which are eccentrically arranged with respect to each other and with respect to the central electron beam 18, and each of which comprises twelve pole shoes 83*a* to 831 and 84*a* to 841 (84*a* and 841 only partly shown in FIG. 5). About each pole shoe 83*a* to 831, 84*a* to 841 there are provided coils 85*a* to 851 and 86*a* to 861, respectively.

In conjunction with the ring 81, the twelve coils 85*a* to 851 form two independently operating six-pole electromagnetic systems I and II.

The poles of each system are situated at the corners of a regular hexagon, the system I being shifted 30° with respect to the system II. The system I has associated therewith the coils 85*a,* 85*c,* 85*e,* 85*g,* 85*i,* and 85*k.* The system II hasassociated therewith the coils 85*b,* 85*d,* 85*f,* 85*h,* 85*j* and 851. By means of the coils 85*a,* 85*e,* 85*i* a magnetic field is generated in the pole shoes 83*a,* 83*e,* and 83*i* when the coils are excited, this magnetic field having the same intensity as the magnetic field generated in the pole shoes 85*c,* 85*g* and 85*k* by the coils 85*c,* 85*g* and 85*k* and having the opposite direction with respect to the beam 18. Similarly, in the pole shoes 83*b,* 83*f* and 83*j* a magnetic field is generated by the coils 85*b,* 85*f* and 85*j* which has the same intensity as the magnetic field generated by the coils 85*d,* 85*h* and 85*l* in the pole shoes 83*d,* 83*h* and 83*l* and which has the opposite direction with respect to the beam 18.

The coils 86*a* to 86*l* of which 86*i-k* are shown in FIG. 5 also constitute, in conjunction with the ring 82, two independently operating six-pole electromagnetic systems III, IV, the coils 86*a* to 86*l* having the same arrangement and operation as the coils 85*a* to 85*l.*

The rings 81 and 82 and the coils 85*a* to 85*l* and 86*a* to 86*l* provided thereon are secured on a carrier (not shown in FIG. 5) which is similar to the carrier 41 of FIGS. 3 and 4. The rings and coils are mounted on the neck of the colour display tube by way of the carrier. Mounting is preferably effected such that the forces to be generated by the magnetic fields act either perpendicular to or in the plane of which the three electron beams 17, 18 and 19 are situated. (FIG. 5 shows such a positioning).

Figure 6:
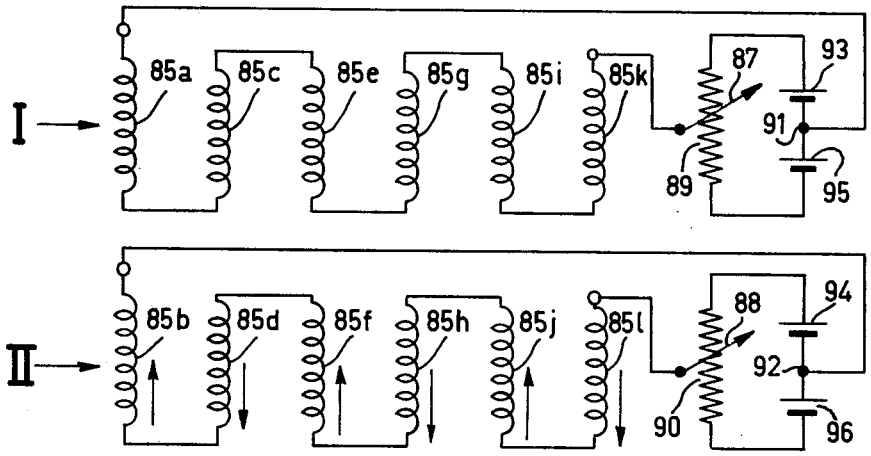
FIG. 6 shows an embodiment of a circuit used in the electromagnetic convergence unit shown in FIG. 5.

The electrical circuit of the system I and II shown in FIG. 6 is very simple. This is achieved by forming the coils 85*a* to 85*l* and 86*a* to 86*l* of the same number of windings and by winding these coils in the same direction. The coils of each system I, II are connected in series such that each coil can carry a current (indicated by arrows in the Figure for system II) which flows in a direction opposite to the current in a neighbouring coil.

The systems I and II are connected on the one side to the wipers 87 and 88 of the potentiometers 89 and 90, respectively and on the other wise of the connections 91 and 92, respectively, between the voltage sources 93 and 95, 94 and 96. The potentiometers 89 and 90 are connected to the series connection of the voltage sources 93 and 95, 94 and 96. The current intensity and the direction thereof can thus be adjusted in the systems I and II by means of the wipers 87 and 88.

Figure 7:
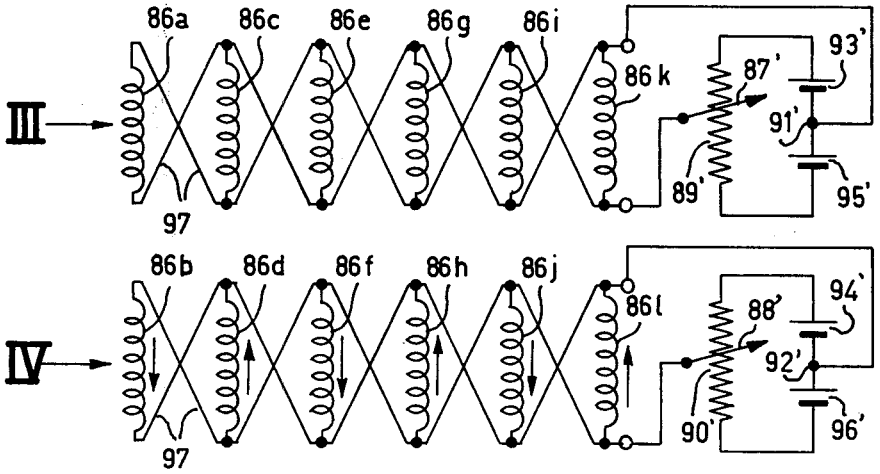
FIG. 7 shows a further embodiment of a circuit used in the electromagnetic convergence unit shown in FIG. 5.

The coils 86*a* to 86*l* of the systems III and IV are connected in parallel in a second embodiment of an electrical circuit in FIG. 7. To this end, the coils of each system should have the same number of ampere-turns and the same winding direction with respect to each other. The connections 97 are arranged such that the current through a coil has a direction (indicated by arrows in system IV) opposite to that in the neighbouring coil.

The systems III and IV are connected to circuits (87′ and 96′). Similar to the circuits whereto the systems I and II are connected in FIG. 6. Using the wipers 87, 88, 87′ and 88′ shown in the FIGS. 6 and 7, the following corrections can be independently performed in a convergence unit 80 as shown in FIG. 5:

Wiper 87: correction of the electron beam 17 in the horizontal direction.

Wiper 88: correction of the electron beam 17 in the vertical direction.

Wiper 87′: correction of the electron beam 19 in the horizontal direction.

Wiper 88′: correction of the electron beam 19 in the vertical direction.

What is claimed is:

1. In combination with a color display tube having three electron guns arranged in a single plane, a device for the static convergence of electron beams generated by the electron guns, said device enclosing the neck of the color display tube and comprising at least two annular magnetic six-pole structures, which are arranged eccentrically with respect to the neck of the color display tube and to each other, the axis of rotation of a first of said magnetic structures being situated halfway between one outer electron beam and the central electron beam and the axis of the second magnetic structure being situated halfway between the central electron beam and the other electron outer beam.

2. The combination of claim 1, further comprising a means for rotating the magnetic field of each structure through an angle of at least 120° with respect to the axis of rotation to the respective magnetic structure.

3. The combination of claim 1, wherein each of said magnetic structures comprises a pair of annular six-pole magnets, the annular six-pole magnets of each pair being independently rotatable.

4. The combination of claim 3, further comprising means for rotating said annular six-pole magnets of each pair through opposite equal angles with respect to their common axis of rotation.

5. The combination of claim 1, wherein each of said annular magnetic six-pole structures comprise an electro-magnet, and further comprising means for controlling the strength of field of the respective poles.

6. The combination of claim 5, wherein said each electro-magnet further comprises six additional poles, and means for controlling the magnetic strength of the respective six additional poles, the poles of said additional electro-magnet being intermediate the poles of said first mentioned electro-magnet.

* * * * *

UNITED STATES PATENT AND TRADEMARK OFFICE

CERTIFICATE OF CORRECTION

PATENT NO. : 4,045,754

DATED : August 30, 1977

INVENTOR(S) : PIET G.J. BARTEN

It is certified that error appears in the above-identified patent and that said Letters Patent are hereby corrected as shown below:

In the Title Page, Section [30], "Mar. 13, 1977" should be --Mar. 13, 1975--

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*